US008011192B2

(12) United States Patent
Gupte

(10) Patent No.: US 8,011,192 B2
(45) Date of Patent: Sep. 6, 2011

(54) METHOD FOR DEFROSTING AN EVAPORATOR IN A REFRIGERATION CIRCUIT

(75) Inventor: Neelkanth S. Gupte, Katy, TX (US)

(73) Assignee: Hill Phoenix, Inc., Conyers, GA (US)

( * ) Notice: Subject to any disclaimer, the term of this patent is extended or adjusted under 35 U.S.C. 154(b) by 691 days.

(21) Appl. No.: 11/993,499

(22) PCT Filed: Jun. 23, 2005

(86) PCT No.: PCT/US2005/022201

§ 371 (c)(1),
(2), (4) Date: Jan. 18, 2008

(87) PCT Pub. No.: WO2007/001284

PCT Pub. Date: Jan. 4, 2007

(65) Prior Publication Data

US 2009/0320504 A1 Dec. 31, 2009

(51) Int. Cl.
*F25B 41/00* (2006.01)

(52) U.S. Cl. ..... 62/81; 62/272

(58) Field of Classification Search ..... 62/81, 82, 62/154, 234, 278, 352, 152, 196.4, 504, 151, 62/159, 198, 199

See application file for complete search history.

(56) References Cited

U.S. PATENT DOCUMENTS

| | | | | |
|---|---|---|---|---|
| 2,178,445 | A * | 10/1939 | Warneke | 62/155 |
| 2,928,256 | A * | 3/1960 | Nonomaque | 62/156 |
| 3,427,819 | A * | 2/1969 | Seghetti | 62/196.4 |
| 3,602,004 | A | 8/1971 | Peavler et al. | |
| 3,645,109 | A * | 2/1972 | Quick | 62/196.2 |
| 4,102,151 | A * | 7/1978 | Kramer et al. | 62/278 |
| 4,147,037 | A * | 4/1979 | Gelbard et al. | 62/113 |
| 4,813,239 | A * | 3/1989 | Olson | 62/81 |

(Continued)

FOREIGN PATENT DOCUMENTS

| | | | |
|---|---|---|---|
| GB | 895227 | A | 5/1962 |
| GB | 1 505 711 | A | 3/1978 |
| GB | 1505711 | A | 3/1978 |
| RU | 2287119 | C2 | 11/2006 |
| SU | 354240 | | 10/1972 |

OTHER PUBLICATIONS

PCT International Preliminary Report on Patentability relating to International Application No. PCT/US2005/022201, date of completion of this report, Jul. 26, 2007 (9 pgs.).

(Continued)

*Primary Examiner* — Frantz Jules
*Assistant Examiner* — Lukas Baldridge
(74) *Attorney, Agent, or Firm* — Foley & Lardner LLP

(57) ABSTRACT

Method for defrosting an evaporator in a refrigeration circuit (2) for circulating a refrigerant in a predetermined flow direction, the refrigeration circuit (2) comprising in flow direction a compressor unit (4), a heat-rejecting heat exchanger (6), an expansion device (12) and an evaporator (14), wherein the evaporator (14) comprises at least two refrigerant conduits (42; 44) and the method comprises the following steps: (a) operating the refrigeration circuit (2) in the normal cooling mode where the refrigerant exiting the heat-rejecting heat exchanger (6) flows through the expansion device (12) and through the evaporator (14) and towards the compressor unit (4); (b) terminating the cooling mode by interrupting the flow of the refrigerant exiting the heat-rejecting heat exchanger (6) into the evaporator (14); and (c) directing hot gas refrigerant through only a portion of the refrigerant conduits (42; 44) of the evaporator (14) for defrosting the evaporator (14).

12 Claims, 7 Drawing Sheets

U.S. PATENT DOCUMENTS

| | | | | |
|---|---|---|---|---|
| 5,048,303 | A | 9/1991 | Campbell et al. | |
| 5,694,782 | A * | 12/1997 | Alsenz | 62/156 |
| 6,094,925 | A | 8/2000 | Arshansky et al. | |
| 6,170,270 | B1 | 1/2001 | Arshansky et al. | |
| 6,185,951 | B1 | 2/2001 | Lane et al. | |
| 6,804,976 | B1 * | 10/2004 | Dain | 62/525 |
| 6,807,813 | B1 * | 10/2004 | Lesage | 62/81 |
| 6,883,343 | B2 | 4/2005 | Lane et al. | |
| 6,889,514 | B2 | 5/2005 | Lane et al. | |
| 6,889,518 | B2 | 5/2005 | Lane et al. | |
| 6,915,652 | B2 | 7/2005 | Lane et al. | |
| 6,981,385 | B2 | 1/2006 | Arshansky et al. | |
| 7,275,376 | B2 | 10/2007 | Swofford et al. | |
| 2007/0289323 | A1 | 12/2007 | Swofford et al. | |
| 2010/0300122 | A1 * | 12/2010 | Heinbokel | 62/81 |

OTHER PUBLICATIONS

PCT International Search Report relating to International Application No. PCT/US2005/022201, date of mailing of the International Search Report, Mar. 8, 2006 (2 pgs.).

PCT Written Opinion of the International Searching Authority relating to International Application No. PCT/US2005/022201, date of receipt of the Opinion, Mar. 6, 2006 (5 pgs.).

Office Action for Application No. 05 766 907.9-2301, dated Mar. 15, 2010, 27 pages.

Office Action for Application No. 05 766 907.9-2301, dated Oct. 27, 2009, 3 pages.

* cited by examiner

METHOD FOR DEFROSTING AN EVAPORATOR IN A REFRIGERATION CIRCUIT

FIELD

The present invention relates to a method for defrosting an evaporator in a refrigeration circuit for circulating a refrigerant in a predetermined flow direction, the refrigeration circuit comprising in flow direction a compressor unit, a heat-rejecting heat exchanger, an expansion device and an evaporator. The present invention further relates to a corresponding refrigeration circuit as well as an evaporator for use within such a refrigeration circuit and in combination with such method.

BACKGROUND

Icing of an evaporator in a refrigeration circuit is a common problem. Vapor from ambient air condenses and freezes on the heat exchanging surfaces of the evaporator in the conventional cooling mode and forms a continuously increasing ice layer over the time. It is known that such ice layer reduces the efficiency of the heat transfer through the evaporator resulting in loss of efficiency and increase of operational costs of the refrigeration system.

A conventional evaporator comprises at least one conduit for directing the refrigerant through the evaporator and typically fins for increasing the heat exchange surface of the evaporator. The conduit frequently is a serpentine tube with a plurality of passes through the evaporator and the fins are plate like elements having openings through which the individual passes or sections of the tube extend. The fins and tube sections are fixed to each other, for example by means of a force fit and provide each other the required structural stability.

It is conventional to remove the ice accumulation on the evaporator by way of defrosting the evaporator. A typical method for defrosting is interrupting the normal cooling operations and to defrost the evaporator. It is possible to speed up the defrosting cycle by providing heat to the evaporator. In many applications, the temperature in the environment of the evaporator is critical. If, for example, the refrigeration circuit is part of a supermarket refrigeration system, the evaporators are typically within the display cabinets and a sudden temperature increase of the nutrition within such display cabinet during defrost operation should be avoided under all circumstances. The defrost operation should, therefore, be completed within a very short time, which requires the supply of a substantial amount of heat within a short time period. On the other hand, due to space requirement and economical reasons, any additional defrost apparatus should be avoided.

SUMMARY

It is an object of the present invention to provide a method for defrosting an evaporator in a refrigeration circuit which is simple, which allows for the supply of a substantial amount of heat within a very short time, which avoids heating of the environment of the evaporator and which is not increasing the operational costs.

In accordance with an embodiment of the present invention a method for defrosting an evaporator in a refrigeration circuit is provided, which comprises the following steps:

(a) operating the refrigeration circuit in the normal cooling mode where the refrigerant exiting the heat-rejecting heat exchanger flows through the expansion device and through the evaporator and towards the compressor;

(b) terminating the cooling mode by interrupting the flow of the refrigerant exiting the heat-rejecting heat exchanger into the evaporator; and (c) directing hot gas refrigerant through only a portion of the refrigerant conduits of the evaporator for defrosting the evaporator.

The required heat is provided in the form of a hot gas refrigerant. It is possible to supply the hot gas refrigerant from the refrigeration circuit. Such hot gas refrigerant is directed to the evaporator in order to provide the heat for defrosting it. The hot gas refrigerant can be directed through the evaporator within a core portion thereof, i.e. a portion which is typically within the ice layer to be removed during the defrost cycle. The ice layer insulates the hot gas against the environment of the evaporator and avoids any major temperature variations. Best case, the flow of hot gas refrigerant to the evaporator is terminated once the ice is completely defrosted so that substantially no temperature increase is observed in the environment of the evaporator.

The hot gas used for defrosting can be directed from the exit or near the exit of the compressor unit of the refrigeration circuit. The gas leaving the compressor unit and entering the heat-rejecting heat exchanger, respectively is at high pressure and high temperature.

It is possible to direct the hot gas refrigerant through a refrigerant conduit of the evaporator. It is possible that the evaporator comprises two or more refrigerant conduit and it can be preferred to have refrigerant conduits of different properties, for example different strength, etc., in order to allow passing of the high temperature, high pressure gases refrigerant through the evaporator. The high pressure high temperature refrigerant will be passed through those conduits only during defrost operation which can sustain the high pressure, high temperature, etc. of the hot gas refrigerant. It is possible to pass the refrigerant exiting the heat rejection heat exchanger through all conduits, independent of their properties like strength, etc. during normal cooling mode. Thus, all the conduits within the evaporator are in use during the normal cooling mode, thus increasing the efficiency of the evaporator. It is also possible to provide all the conduits with the sufficient properties. One might also contemplate to pass the refrigerant exiting the heat-rejecting heat exchanger through only part of the conduits during normal cooling mode.

A sensor, or for example, a temperature sensor or the like, can be provided for sensing the icing condition of the evaporator. If a sensor is present, the method can include the steps of automatically initiating the defrost operation once a predetermined icing condition has been sensed and/or terminating the defrost operation once a predetermined defrost condition has been sensed. This allows for automatically surveying the icing condition of the evaporator and for automatically defrosting the evaporator once the system has determined the need for defrosting the evaporator. It is possible to provide a timing means for conducting defrosting operations at a particular time only, for example with supermarket refrigeration systems at night time only or at times where no or only a reduced number of customers is present. This might be preferred, since cooling requirements are typically less if no customers access the display cabinets so that undue increase of the temperature of the nutrition in the display cabinet during defrost mode is avoided. Such a timing of the defrost operation might further be advantageous in case of very high pressure of the hot gas refrigerant, for example with $CO_2$ refrigeration circuits. With such systems, the high pressure hot gas refrigerant in the customers area of a supermarket is sometimes regarded a risk which should be avoided. In such a situation, the flow of the hot gas refrigerant to the evaporator can be blocked outside the customers area of the supermarket, for example in the machine room of the refrigeration circuit and particularly next to the compressor unit itself. After termination of the defrost operation, the high pressure hot gas refrigerant in the defrost line can be drained, for example to any particular location in the refrigeration system. Accordingly, during opening hours of the supermarket no high pressure is present in the customers area.

The hot gas refrigerant exiting the evaporator during the defrost operation can be drained or returned to the liquid feed line of the refrigeration circuit.

In preparation of the defrosting operation, in particularly just in advance of letting the hot gas refrigerant into and through the evaporator, it might be advantageous to provide a step of evacuating the evaporator subsequent to the interruption of the normal flow of the refrigerant exiting the heat-rejecting heat exchanger to the evaporator. The evacuation of the evaporator can be performed by the compressor unit. Once the evacuation has been completed, the connection to the compressor unit can be closed and the compressor unit might even be shot down. The compressor unit may also be disconnected from the evaporator if no evacuation of the evaporator is performed. Also in this case, the compressor unit can be shut down. Alternatively, the compressor unit can continue to work, for example in case the defrost operation is performed only for a single or some evaporator out of a plurality of evaporators at a time.

After the defrost operation, the flow of hot gas refrigerant to the evaporator can be shut down. It is possible to evacuate the evaporator subsequent to terminating the flow of the hot gas refrigerant, before returning to the normal operation, i.e. in advance of letting refrigerant exiting the heat-rejecting heat exchanger flow through the evaporator.

The present invention further relates to a refrigeration circuit for circulating a refrigerant in a predetermined flow direction, comprising in flow direction a compressor unit, a heat-rejecting heat exchanger, an expansion device and an evaporator, wherein the refrigeration circuit further comprises a hot gas line leading to the evaporator and a defroster valve positioned in the hot gas line. The hot gas line can extend from an exit of the compressor unit to an entrance of the evaporator. The hot gas line may also extend from many other source of hot gas refrigerant to an entrance of the evaporator. The hot gas line may be connected to only one or only part of the evaporator's refrigerant conduits. It is possible to have the individual refrigerant conduits within the evaporator physically completely separate from each other. If there is a connection between the refrigerant conduits of the evaporator, a valve can be provided in such connection line or bridge line. The valve can be arranged, either physically or electronically, etc., with the defroster valve so that merely one of the defroster valve and such valve can be opened at a time.

An entrance bridge line can be provided connecting the entrances of two or more refrigerant conduits and comprising an entrance valve. There can be an exit bridge line connecting the exits of the two refrigerant conduits and comprising an exit valve.

The refrigeration circuit can be used for industrial cooling systems, supermarket refrigeration systems, etc. The refrigeration circuit can provide cooling at different temperature levels, like low temperature cooling for display cabinets for frozen food, medium temperature cooling for fish, milk products, etc. The hot gas for defrosting for example the low temperature circuit can be derived from the medium temperature circuit and vice versa. It is also possible to return the refrigerant after defrosting to the respectively other circuit.

The present invention further relates to an evaporator for a refrigeration circuit in accordance with any embodiment of the invention comprising two refrigerant conduits with one thereof being of higher strength than the other refrigerant conduit.

BRIEF DESCRIPTION OF THE FIGURES

Embodiments of the present invention are described in greater detail below with reference to the figures, wherein.

DETAILED DESCRIPTION

Figure 1:
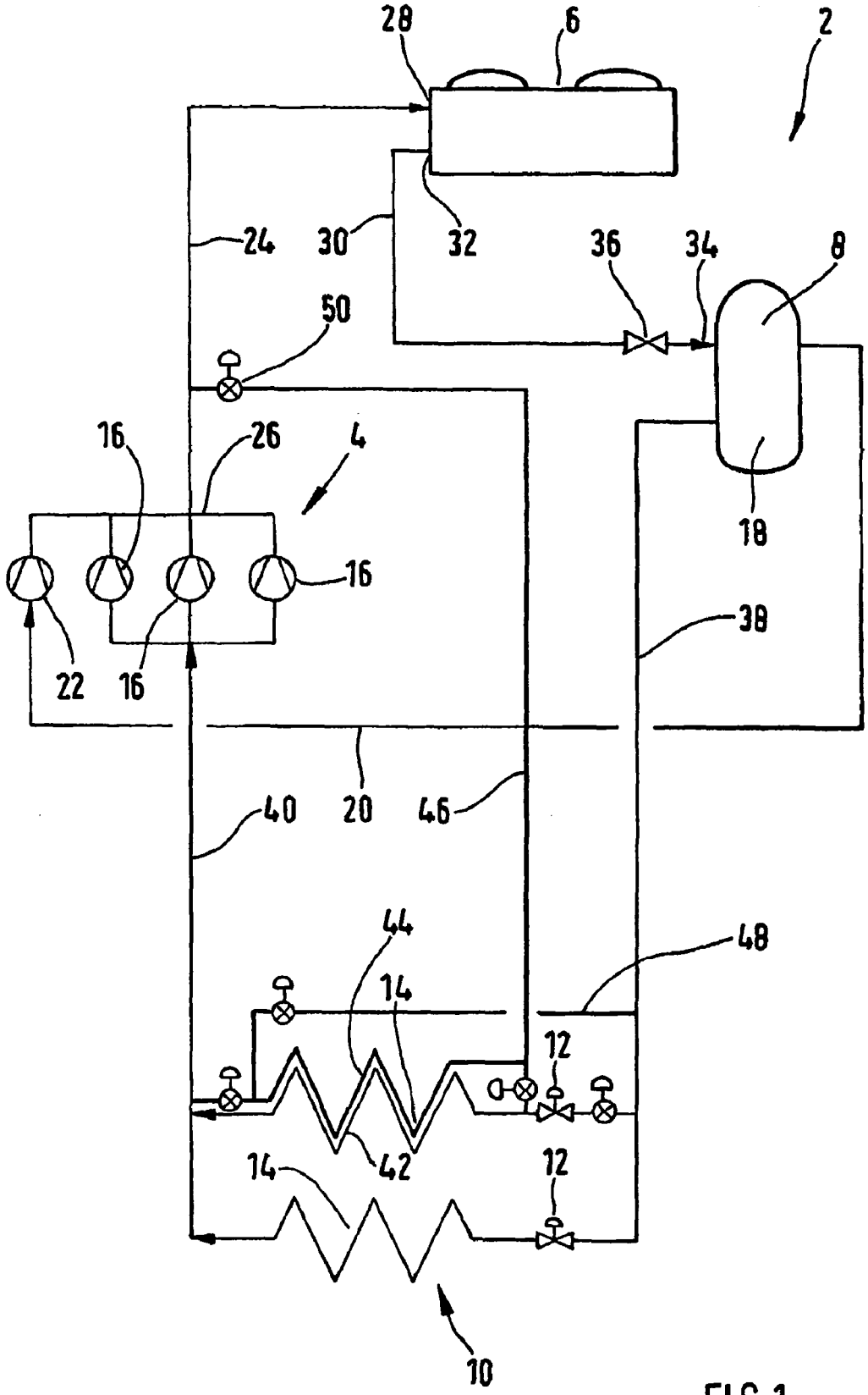
FIG. 1 shows a refrigeration circuit in accordance with the present invention.

FIG. 1 shows a refrigeration circuit 2 for circulating a refrigerant in a predetermined flow direction. The refrigeration circuit 2 comprises in flow direction a compressor unit 4, a heat-rejecting heat exchanger 6, a receiver 8, at least one refrigeration consumer 10 comprising an expansion device 12 and an evaporator 14.

The compressor unit can comprise one or a plurality of compressors 16 connected serially or in parallel with each other.

The heat-rejecting heat exchanger 6 can be a condenser if a conventional refrigerant is used. In case a "super critical" refrigerant, like $CO_2$, etc., is used, i.e. if the refrigeration circuit 2 is operated in the super critical mode at least under particular operational conditions, the heat-rejecting heat exchanger 6 is of the type as termed a gascooler.

The receiver or liquid/fluid separator 8 receives the refrigerant exiting the heat-rejecting heat exchanger 6. Liquid refrigerant collects in the lower portion 18 of the receiver 8 with gaseous refrigerant being present in the upper portion of the receiver 8. A flash gas line 20 connects the upper portion of the receiver 8 with the compressor unit 4 and particularly a separate compressor 22 in case of the present embodiment. The separate compressor 22 can be controlled independently so that the step of compressing the flash gas can be optimized, particularly in respect of economic operation.

A high pressure line 24 connects the outlet 26 of the compressor unit 4 with the inlet 28 of the receiver 8. In a typical application of the refrigeration circuit 2 in a supermarket refrigeration system for medium temperature cooling, i.e. where the refrigeration consumers 10 cool display cabinets for meat, milk products, fish, etc. to a temperature of slightly above 0° C., the pressure in the high pressure line 24 can be up to 120 bar and is typically approximately 85 bar in "summer mode" and approximately 45 bar in "winter mode". The temperature of the refrigerant in the high pressure line 24 is approximately 120° C.

In the heat-rejecting heat exchanger, the temperature of the refrigerant is typically reduced to approximately 35° C., while the pressure of the refrigerant remains substantially unchanged. A high pressure connection line 30 connects the output 32 of the heat-rejecting heat exchanger 6 with the inlet 34 of the receiver 8. An intermediate expansion device 36 is located in the high pressure connection line 30. in the above example of medium temperature cooling the intermediate expansion device 36 reduces the pressure to between 30 and 40 bar and preferably 36 bar with such intermediate pressure being typically independent from "winter mode" and "summer mode". A corresponding temperature subsequent to the intermediate expansion device 36 is approximately 0 to 5° C.

A liquid line 38 connects the liquid portion 18 of the receiver 8 with the refrigeration consumers 10. An expansion device 12 of the refrigeration consumer 10 can reduce the pressure to typically between 20 and 30 bar and approximately 26 bar which results in a temperature of approximately −10° C. in the evaporator 14. The refrigerant exiting the evaporator 14 is directed via suction line 40 to the compressor unit 4.

As the evaporator 14 of each refrigeration consumer 10 is in contact with ambient air, it typically comprises surface extending means likes fins, etc. The contact with the ambient air during operation results in freezing of water from ambient air to the heat exchanger surfaces of the evaporator 14 with a resultant accumulation of ice over such surfaces. This icing of the evaporator results in a substantial drop of efficiency. For deicing purposes, the present invention provides for at least two refrigerant conduits 42, 44 in the evaporator, a hot gas refrigerant line 46 for supplying hot gases refrigerant for defrosting purposes and a defrost return line 48 for returning the refrigerant to the main portion of the refrigeration circuit 2.

Figure 2:
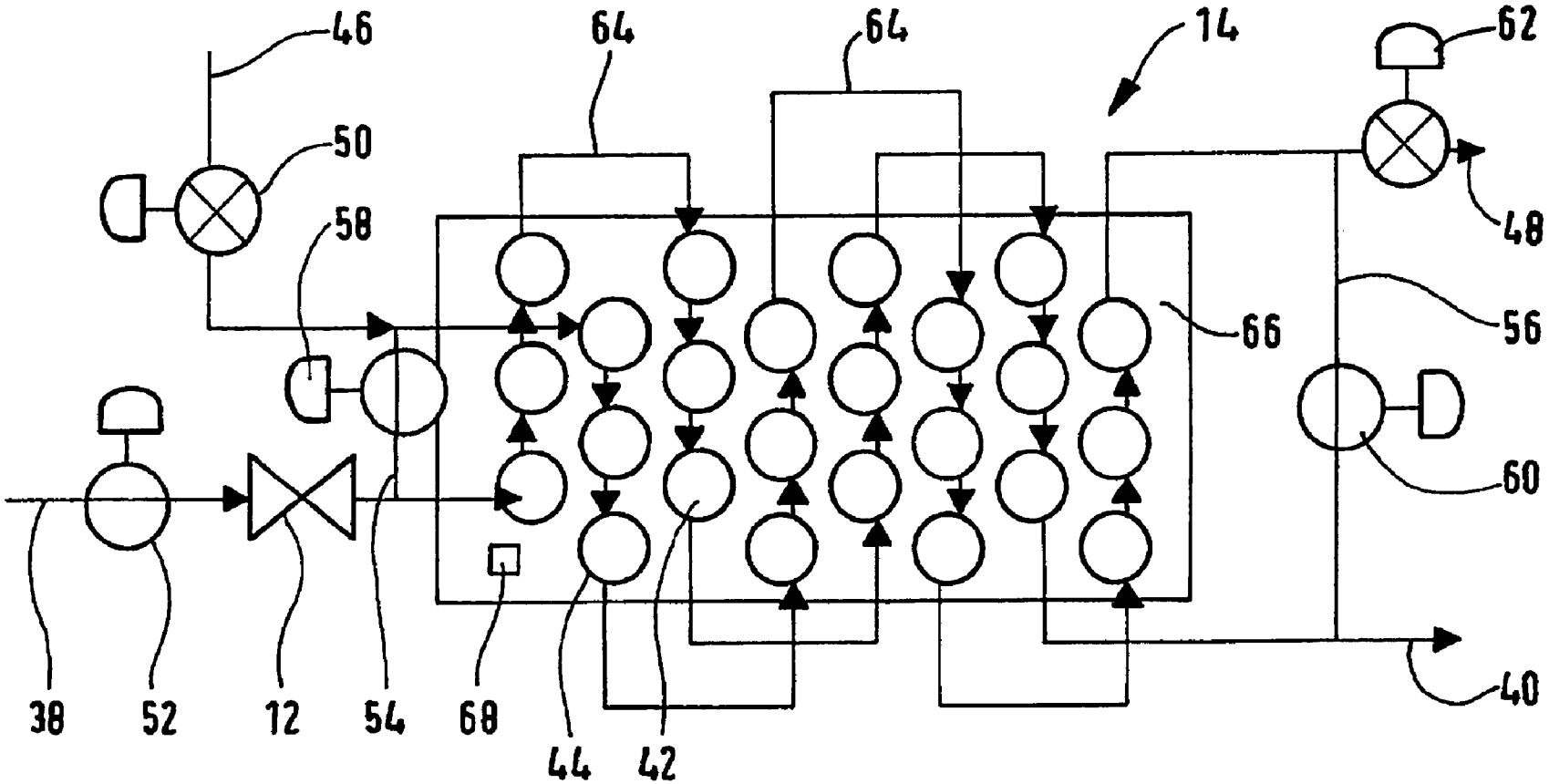
FIG. 2 shows an evaporator in accordance with the present invention with its associated piping and valves in the normal cooling mode.

The piping of the evaporator 14 in the refrigeration circuit 2 is described with respect to FIG. 2. A defroster valve 50 is located in the hot gas line. A liquid feed valve 52 is position in the liquid line 38, preferably in advance of the expansion device 12 in flow direction. The expansion device 12 is preferably a controllable expansion device in order to control the temperature and the refrigeration capacity, respectively of the evaporator. The liquid feed valve 52 and the expansion device 12 can be combined with each other or integrated with each other.

An entrance bridge line 54 connects the hot gas line 46 with the liquid line 38 and the different refrigerant conduits 42 and 44, respectively, with each other. Similar, an exit bridge line 56 connects the suction line 40 with the return line 48 and the refrigerant conduits 42 and 44, respectively, with each other. An entrance valve 58 can be present in the entrance bridge line 54 and an exit valve 60 can be located in the exit bridge line 56. A return valve 62 can be located in the return line 48.

The refrigerant conduits 42, 44 are of different characteristics. Particularly, the hot gas refrigerant conduit 44 has characteristics allowing to direct the hot pressure high temperature hot gas therethrough. Thus, the refrigerant conduit 44 is preferably of higher strength then the refrigerant conduit 42, preferably having a higher wall thickness than the refrigerant conduit 42. The refrigerant conduit 44 can also be made from a material with good thermal properties, allowing the contact with the hot gas and further for accommodating for the high temperature differences during the defrost operation.

The hot gas refrigerant conduit 44 and the refrigerant conduit 42 can be routed through the evaporator 14 in several passes with return portions 64 so that each refrigerant conduit 42, 44, which preferably includes a plurality of tubes, goes back and forth through the evaporator 14. Connected to the refrigerant 42, 44 are fins 66 as it is well-known in the art.

The arrangement of the hot gas refrigerant conduits 44 and the refrigerant conduits 42 within the evaporator 14 can be optimized for the particular application. Preferably, the distribution of the hot gas refrigerant conduit 44 within the evaporator 14 is such that the defrost operation can be performed evenly over the evaporator so that the defrost operation is completed at any place within the evaporator at approximately the same time.

A sensor 68 can be provided for sensing the icing condition of the evaporator. The sensor 68 can be a conventional temperature sensor, for example a thermal couple, etc. Any other types of sensors, for example optical sensors, physical sensors, etc. can be used for sensing the icing condition. The sensor information can be provided to a controller (not shown) which controls the defrost operation. The control may start the defrost mode once a certain time since the last defrost cycle has elapsed. Alternatively, the sensor also provides the information for starting the defrost mode. The control may alternatively stop the defrost operation after a certain predetermined time has elapsed. Alternatively, the control may stop the defrost cycle once the sensor signals a sufficient deicing condition. In case of a temperature sensor, a sufficient deicing condition can be stipulated if the temperature next to a heat exchanging surface of the evaporator 14 clearly exceeds the melting point, preferably at a temperature of between 5 and 20° C. and preferably a temperature of approximately 10 to 15° C.

As can be seen in FIG. 1, the hot gas line 46 can be connected to the exit 26 of the compressor unit 4. The hot gas valve 50 can preferably be next to the compressor unit 4 so that not losses occur if no defrost cycle is running. A return line 48 preferably connects to the liquid line 38 but also can connect to the receiver 8, etc. It is preferred to have a corresponding defrost system for each of the refrigeration consumers 10. An individual defrost system can be provided for each of the refrigeration consumers 10. It is, however, preferred to have a single hot gas line 46 and preferably also a single return line 48 connecting to the defrost systems of the respective refrigeration consumers 10. Preferably, the defrost operation for each individual refrigeration consumer 10 can be performed independently from the other refrigeration consumers 10 so that only one or limited number of refrigeration consumers is defrosted at a time. To this effect, the hot gas line 46 and possibly also the return line 48 can provide respective branch lines leading to individual refrigeration consumers. Valves can be provided in the individual branch lines for connecting and disconnecting to the respective refrigeration consumer. A respective main hot gas valve and/or a respective main return valve can be provided for disconnecting the defrost system from all the refrigeration consumers 10.

Figure 3:
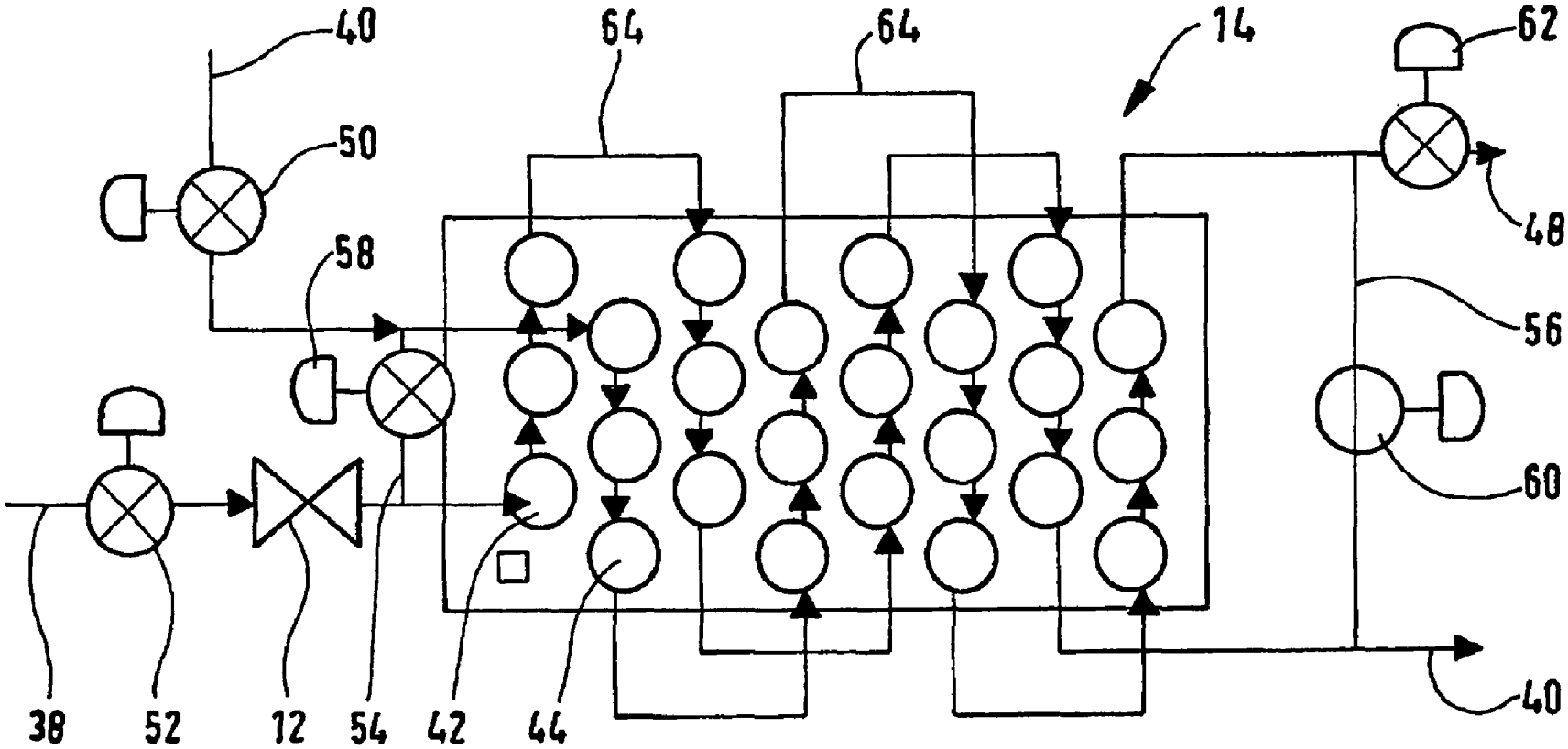
FIG. 3 shows the evaporator of FIG. 2 in an interim mode between normal cooling mode and defrosting mode.
Figure 4:
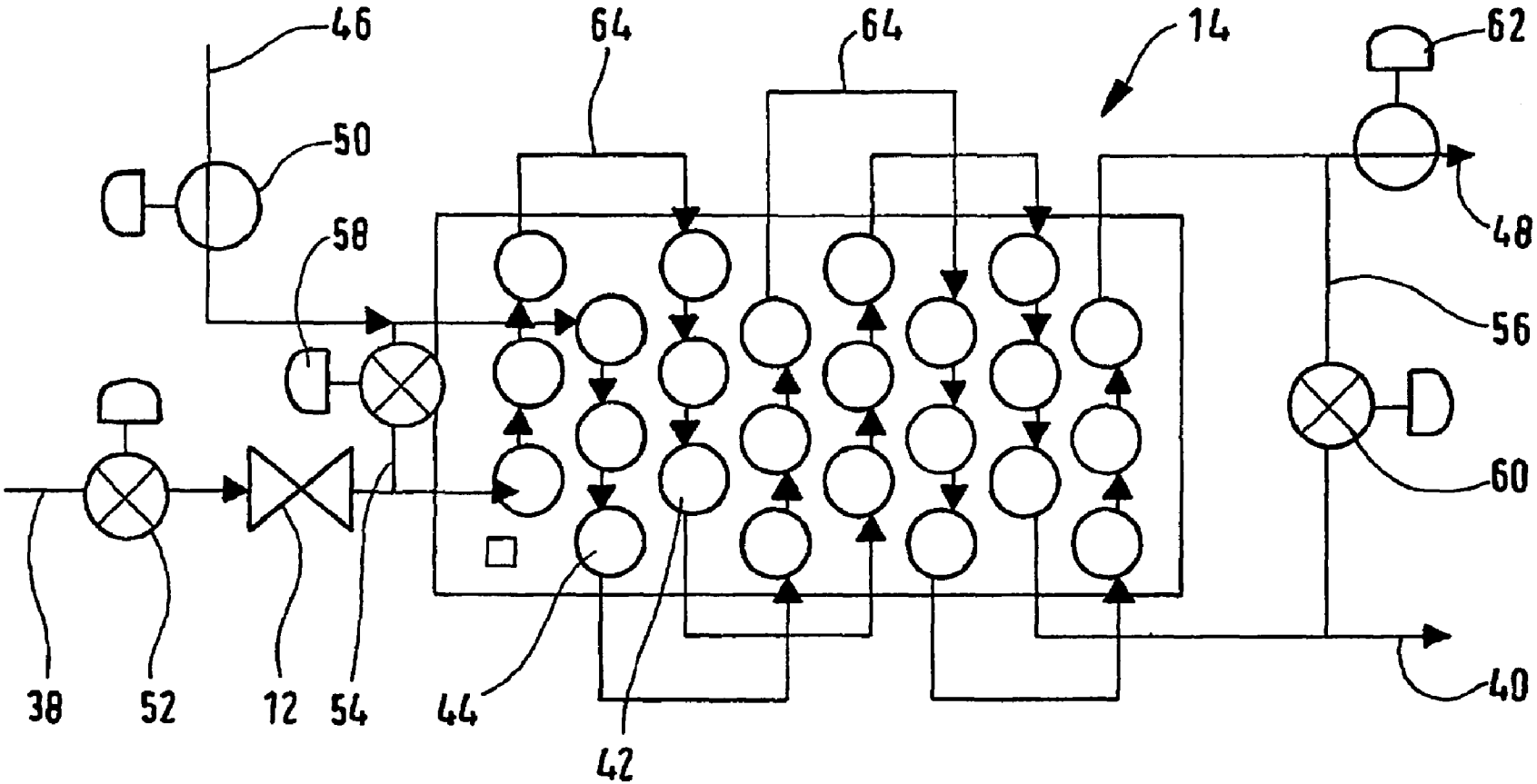
FIG. 4 shows the evaporator of FIG. 2 in the defrosting mode.
Figure 5:
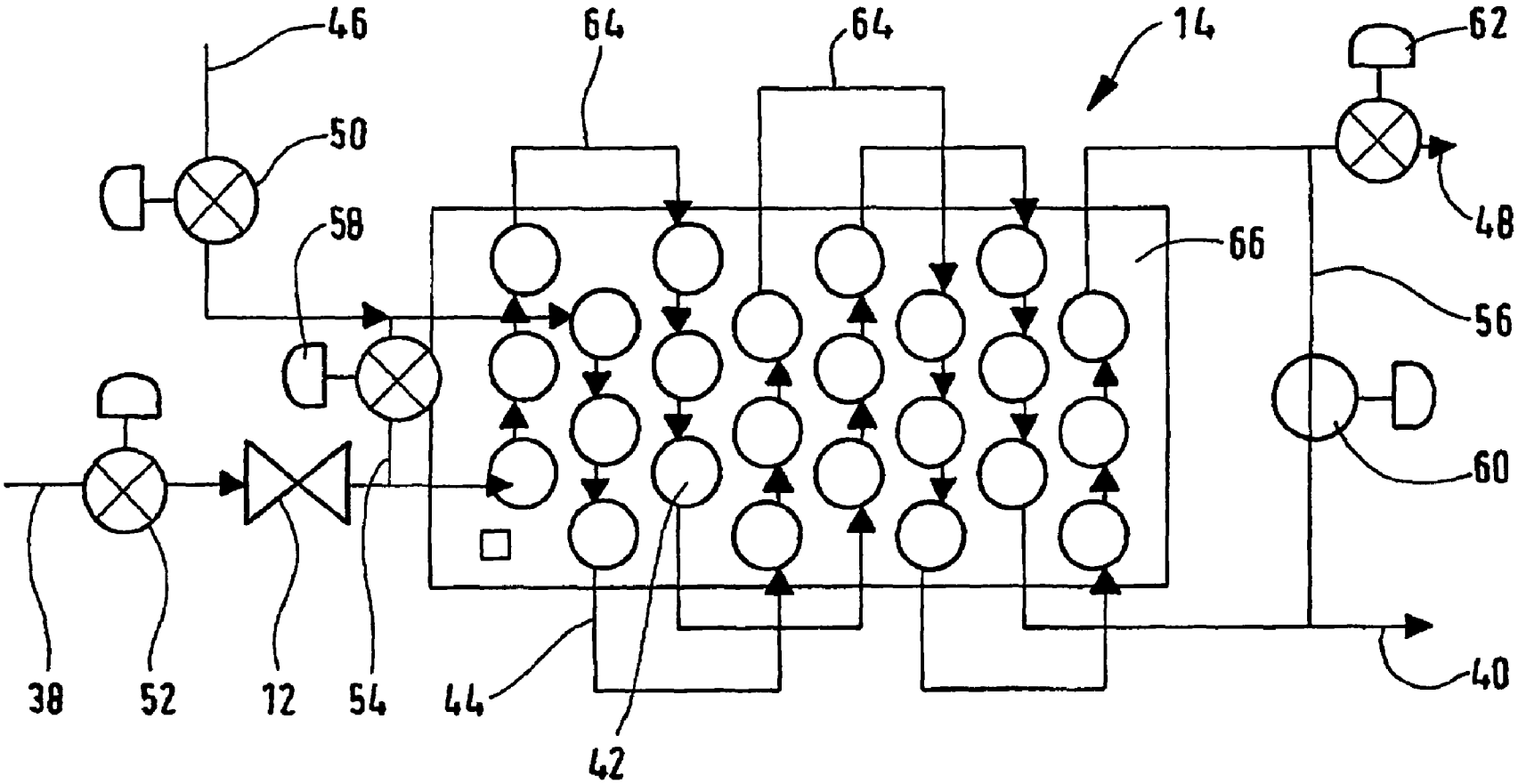
FIG. 5 shows the evaporator of FIG. 2 in an interim mode between defrost mode and normal cooling mode.

With respect to FIG. 2 to 5 a method for defrosting the evaporator 14 is disclosed. In FIG. 2 the operation in the normal cooling mode is shown. Particularly, as represented by the "X" within the valve, the hot gas valve 50 in line 46 is closed, while the liquid feed valve 52 in the liquid line 38 is open, as indicated by the line 38 leading through valve 52. Thus, liquid reactant flows through the expansion device 52 and entrance bridge line 54 via the open entrance valve 58 into both refrigerant conduits 42, 44 and subsequently through exit bridge line 56 and the open exit valve 60 through suction line 40 to the compressor unit 4. In course of switching over to defrost mode, liquid feed valve 52 and entrance valve 58 are closed as shown in FIG. 3. Vapor from both refrigerant conduits 42, 44 is sucked by the compressor unit 4 for a predetermined time. Subsequently, valve 60 is closed, thus isolating the refrigerant conduit 42 and the hot gas conduit 44 from each other. Thereafter, hot gas valve 50 and return valve 62 are opened. High pressure hot gas now enters the hot gas refrigerant conduit 44 and rapid defrost of the evaporator fins 66 begins (FIG. 4).

At the end of the defrost cycle (FIG. 5) which could be sensed in various conventional methods, for example by means of sensor 68, hot gas valve 50 and return valve 48 are closed. Subsequently, exit valve 60 is opened to quickly reduce pressure in the hot gas refrigerant conduit 44.

Then (FIG. 2) liquid feed valve 52 and entrance valve 58 are opened to return to the conventional cooling mode.

The above referenced method and piping allows for using all the refrigerant conduits 42, 44 during normal cooling mode. The respective valves are either by means of the control or physically arranged so that the hot gas line 46 is connectable only to the hot gas refrigerant conduit 44, but not to the refrigerant conduit 42.

Figure 6:
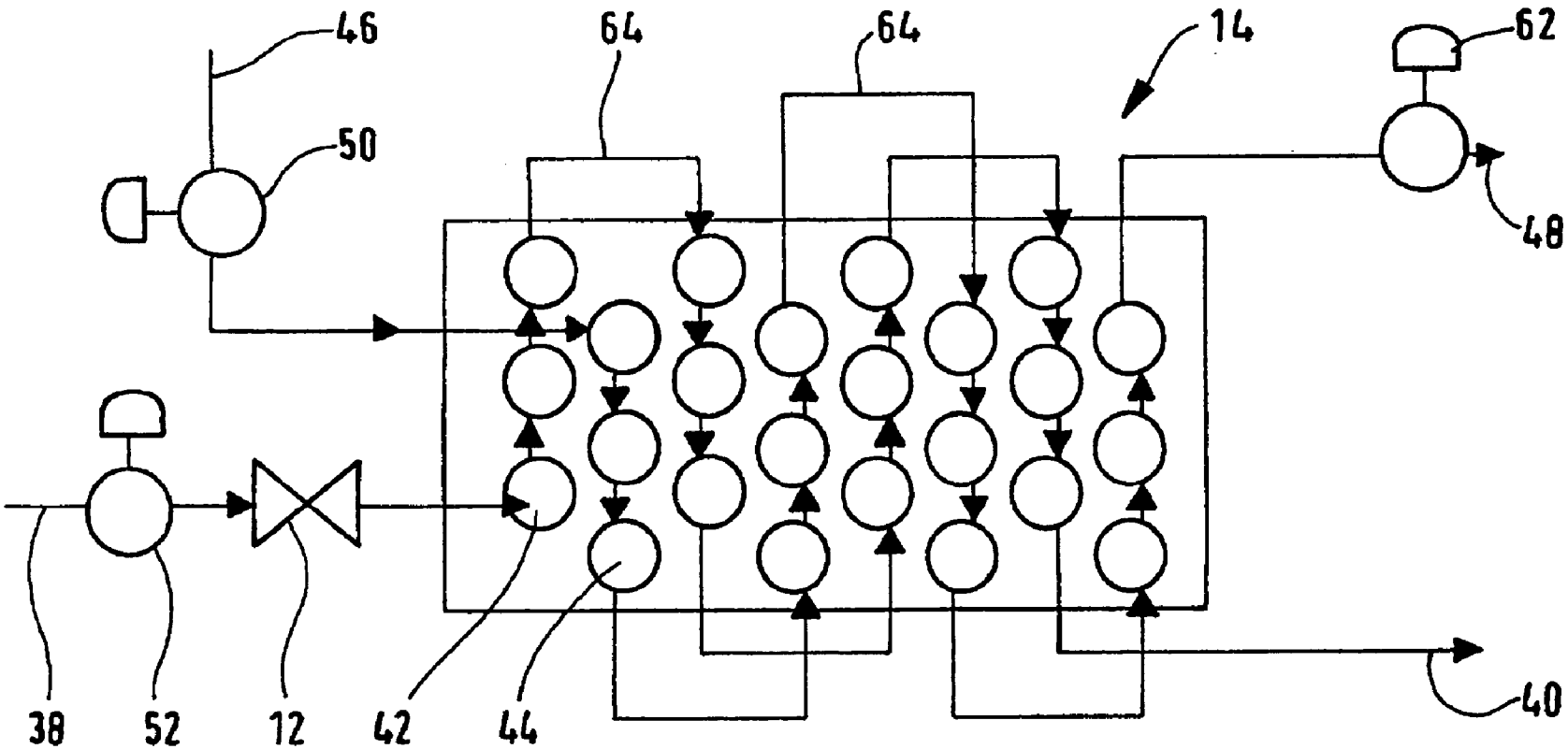
FIG. 6 shows an evaporator in accordance with the present invention with different piping.

The embodiment of FIG. 6 corresponds by and large to the embodiment as disclosed with respect to FIG. 1 to 5. The hot gas refrigerant conduit 44 and the refrigerant conduit 42 are, however, not connectable with each other. Correspondingly, the hot gas refrigerant conduit 44 serves for defrost purposes only but is not in use during conventional cooling operation.

Figure 7:
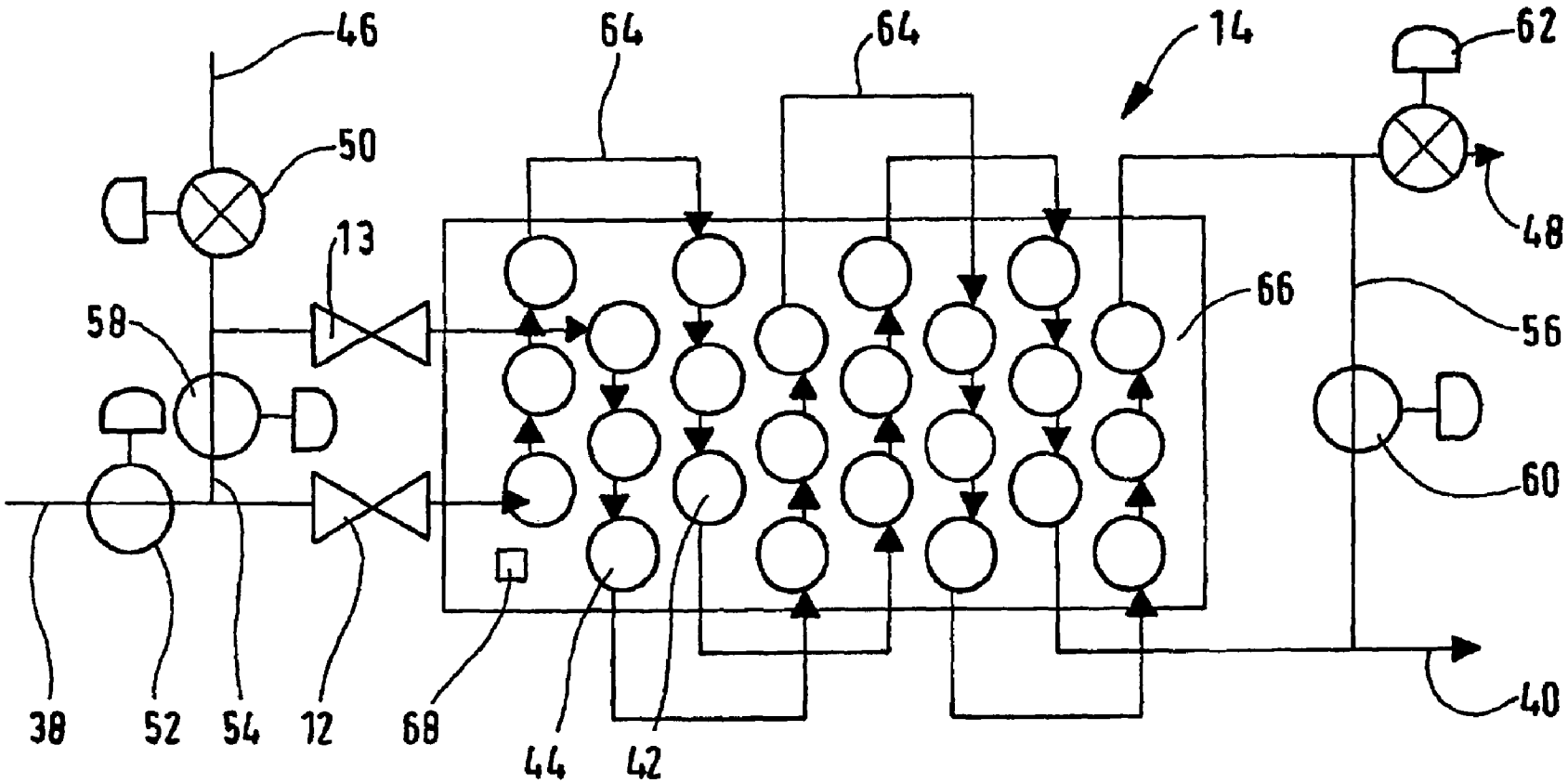
FIG. 7 shows an evaporator similar to that of FIG. 2.

The embodiment of FIG. 7 is very similar to that of FIG. 2. The main difference resides in the fact that the entrance valve 58 is positioned in advance of the expansion devices 12 and 13 in flow direction. The advantage of such a construction is that a single-phase liquid refrigerant is always present at the entrance valve 58 in the embodiment of FIG. 7. In the embodiment of FIG. 2 to 5, also a two-phase refrigerant flow can be present at the entrance valve 58. This requires high quality valves in order to avoid erosion of the valve with two-phase flow and resultant loss in sealing capability. The embodiment of FIG. 7 has two separate expansion valves 12, 13 for low-pressure section and high-pressure section respectively and the entrance valve 58 is on the liquid line 38. A skilled person will understand that the operation of the embodiment of FIG. 7 is similar to that as disclosed in FIG. 2 to 5.

What is claimed is:

1. A method for defrosting an evaporator in a refrigeration circuit for circulating a CO2 refrigerant in a predetermined flow direction, the refrigeration circuit comprising in flow direction a compressor unit to compress the CO2 refrigerant to a high-pressure hot CO2 gas, a heat-rejecting heat exchanger, an expansion device and an evaporator having a plurality of fins, wherein the evaporator comprises at least two refrigerant conduits for receiving the CO2 refrigerant at a low-pressure during a cooling mode, at least one of the refrigerant conduits being a high-strength refrigerant conduit capable of receiving the high-pressure hot CO2 gas from a hot gas CO2 line having a defroster valve during a defrost operation, and at least one of the refrigerant conduits being a lower-strength refrigerant conduit having a strength lower than the high-strength refrigerant conduit, the lower-strength refrigerant conduit not being capable of receiving the high-pressure hot CO2 gas during the defrost operation, and the refrigeration circuit further comprises:

a liquid line having a liquid feed valve and leading to the evaporator;

an expansion device positioned after the liquid feed valve and before the first refrigeration conduit in flow direction;

an entrance bridge connecting the liquid line to the hot gas CO2 line before the refrigerant conduits, the entrance bridge comprising an entrance valve; and wherein the method comprises the following steps:

(a) operating the refrigeration circuit in the cooling mode where the CO2 refrigerant exiting the heat-rejecting heat exchanger flows through the expansion device and through both refrigerant conduits of the evaporator and towards the compressor unit;

(b) terminating the cooling mode by interrupting the flow of the refrigerant exiting the heat-rejecting heat exchanger into the evaporator and closing the liquid feed valve between the compressor unit and the evaporator; and (c) initiating the defrost operation by directing the high-pressure hot CO2 gas refrigerant through only the high-strength refrigerant conduit(s) of the evaporator for defrosting substantially all of the fins on the evaporator.

2. Method according to claim 1, wherein the step (c) includes directing the high-pressure hot CO2 gas refrigerant exiting the compressor unit to the evaporator.

3. Method according to claim 1, further including terminating the defrost operation and returning to the cooling mode.

4. Method according to claim 3, further including a sensor for sensing an icing condition of the evaporator and including the steps of automatically initiating the defrost operation once a predetermined icing condition has been sensed and terminating the defrost operation once a predetermined defrost condition has been sensed.

5. Method according to claim 4, further including the steps of returning the high-pressure hot CO2 gas refrigerant exiting the evaporator during the defrost operation to the liquid line.

6. Method according to claim 5, further including the step of evacuating the evaporator after step (b).

7. Method according to claim 6, further including subsequent to step (c) the step of terminating the flow of high-pressure hot CO2 gas refrigerant to the evaporator and subsequently evacuating the evaporator by operation of the compressor unit before returning to the cooling mode of step (a).

8. A refrigeration circuit for circulating a CO2 refrigerant in a predetermined flow direction, comprising in flow direction a compressor unit to compress the CO2 refrigerant to a high-pressure hot CO2 gas, a heat-rejecting heat exchanger and an evaporator having a plurality of fins and at least first and second refrigerant conduits for receiving the CO2 refrigerant at a low-pressure, wherein the refrigeration circuit further comprises a hot CO2 gas line leading to the evaporator, a defroster valve positioned in the hot CO2 gas line, a liquid line leading to the evaporator and a liquid feed valve positioned in the liquid line capable of being closed for disconnecting the compressor unit from the evaporator, a first expansion device positioned between the liquid feed valve and the first refrigerant conduit, an entrance bridge connecting the liquid line to the hot CO2 gas line before the refrigerant conduits and after the liquid feed valve and the defroster valve in flow direction, the entrance bridge comprising an entrance valve;

wherein the refrigeration circuit is configured such that all conduits within the evaporator are in use during a normal cooing mode and the hot CO2 gas line is fluidly connectable to only some, but not all, of the refrigerant conduits during a defrosting mode, and the hot CO2 gas in the some, but not all, of the refrigerant conduits is operable to defrost substantially all of the plurality of fins on the evaporator, and wherein the refrigerant conduit(s) that are connectable to the hot CO2 gas line during the defrosting mode have a first strength capable of receiving the high-pressure hot CO2 gas, and the refrigeration conduits(s) that are not connectable to the hot CO2 gas line during defrosting have a second strength that is lower than the first strength and are capable of receiving the $CO_2$ refrigerant at the low pressure but are not capable of receiving the high-pressure hot $CO_2$ gas.

9. Refrigeration circuit according to claim 8, wherein the hot $CO_2$ gas line extends from an exit of the compressor unit to an entrance of the evaporator.

10. Refrigeration circuit according to claim 8, wherein at least one of the refrigerant conduits has different material characteristics as compared to the remaining conduits.

11. Refrigeration circuit according to claim 8, further including an exit bridge line connecting the exits of the refrigerant conduits and comprising an exit valve.

12. Refrigeration circuit in accordance of claim 11, the evaporator comprising at least two refrigerant conduits with a portion thereof having different characteristics as compared to the remaining refrigerant conduit(s).

* * * * *